US010260266B2

(12) United States Patent
McCormick

(10) Patent No.: US 10,260,266 B2
(45) Date of Patent: Apr. 16, 2019

(54) AUTOMATED SLIDING DOOR CLOSING SYSTEM FOR WIRE MESH ENCLOSURES

(71) Applicant: Wayne L. McCormick, San Marcos, CA (US)

(72) Inventor: Wayne L. McCormick, San Marcos, CA (US)

( * ) Notice: Subject to any disclaimer, the term of this patent is extended or adjusted under 35 U.S.C. 154(b) by 0 days.

(21) Appl. No.: 15/399,630

(22) Filed: Jan. 5, 2017

(65) Prior Publication Data

US 2018/0187469 A1 Jul. 5, 2018

(51) Int. Cl.

*E05F 1/16* (2006.01)
*E05D 15/06* (2006.01)
*E05B 65/00* (2006.01)

(52) U.S. Cl.

CPC ..... *E05F 1/16* (2013.01); *E05B 65/0007* (2013.01); *E05D 15/06* (2013.01); *E05Y 2900/40* (2013.01)

(58) Field of Classification Search

CPC ..... E05F 1/16; E05B 65/0007; E05D 15/06; E05Y 2900/40; Y10S 292/46
USPC ..... 16/59, 61, 62
See application file for complete search history.

(56) References Cited

U.S. PATENT DOCUMENTS 1,583,835 A * 5/1926 Hynes ..... E05F 15/649 49/363
3,398,424 A * 8/1968 Nieman ..... E05F 1/16 16/80
3,732,594 A * 5/1973 Mills ..... E05F 1/16 16/200
3,887,962 A * 6/1975 Mills ..... E05F 1/16 16/200
4,159,599 A * 7/1979 Richmond ..... E05F 15/649 192/93 R
4,876,764 A * 10/1989 Teague, Jr. ..... G08B 13/08 16/71
2005/0082021 A1* 4/2005 Manning ..... E05F 1/16 160/371
2013/0227815 A1* 9/2013 Wulbrandt ..... C21D 1/06 16/71

FOREIGN PATENT DOCUMENTS

AU B-59073/94 * 10/1994

* cited by examiner

*Primary Examiner* — Gregory J Strimbu
(74) *Attorney, Agent, or Firm* — John R. Ross, III; John R. Ross

(57) ABSTRACT

An automated sliding door closing system to be used with wire mesh enclosures. The door closing system includes support brackets with wire mesh connected between the support brackets. A sliding door track is connected to the support brackets. Sliding door connection bolts slide within the sliding door track and support a sliding door. A spring biased closing mechanism is connected to the sliding door track. The spring biased closing mechanism is biased to keep the sliding door closed. A door roller track is rigidly connected to the sliding door. A connection arm is connected between the spring biased closing mechanism and the door roller track. The connection arm includes a roller inserted into the door roller track. A strike plate is rigidly connected to one of the wire mesh support brackets. The connection arm rotates to close the sliding door after the sliding door has been opened.

3 Claims, 11 Drawing Sheets

AUTOMATED SLIDING DOOR CLOSING SYSTEM FOR WIRE MESH ENCLOSURES

The present invention relates to automated door closing systems and in particular to automated door closing systems for wire mesh enclosures.

BACKGROUND OF THE INVENTION

FIG. 1 shows a prior art wire mesh enclosure 1. Wire mesh sections 3 are connected to support brackets 2A-2B. Opening 4 allows entry into wire mesh enclosure 1. In many instances it is desirable to place a door in front of opening 4 to control entry into wire mesh enclosure 1.

In FIG. 2, sliding door assembly 10 has been connected to wire mesh enclosure 1 so that sliding door 11 is lockable in front of opening 4. FIG. 3A also shows a side view of some of the components of wire mesh enclosure 1 and sliding door assembly 10. Track 12 is connected to support brackets 2A via connection brackets 13. Track 12 includes slot 14 (FIG. 3A). Door support bolts 15 are bolted to sliding door 11 and extend upwards into slot 14. Door support bolts 15 are connected to sliding door carriage 17. Sliding door carriage 17 includes wheel rollers 18 which allow sliding door 11 to slide along track 12. Strike plate 20 is rigidly connected to support bracket 2A.

In FIG. 4, the user has unlocked door 11 by utilizing door lock 25 and the door has been opened as shown. In the prior art the user must remember to close the door manually. Too often the user will forget and leave door 11 in the position shown in FIG. 4. This will allow unauthorized access to items stored in wire mesh enclosure 1 and can result in theft and loss of goods.

What is needed is an improved automated device for closing sliding door for a wire mesh enclosure.

SUMMARY OF THE INVENTION

The present invention provides an automated sliding door closing system to be used with wire mesh enclosures. The wire mesh enclosure includes support brackets with wire mesh connected between the support brackets. A sliding door track is connected to the wire mesh enclosure support brackets by the use of multiple sliding door track connection brackets. Sliding door connection bolts slide within the sliding door track and extend downward from the sliding door track. A sliding door is connected to the sliding door connection bolts and hangs down from the sliding door track. A spring biased closing mechanism is connected to the sliding door track. The spring biased closing mechanism is biased to keep the sliding door closed. A door roller track is rigidly connected to the sliding door. A connection arm is connected between the spring biased closing mechanism and the door roller track. The connection arm includes a roller that is inserted into the door roller track. A strike plate is rigidly connected to one of the wire mesh support brackets. The connection arm of the automated sliding door closing system rotates to close the sliding door after the sliding door has been opened. In a preferred embodiment the spring biased closing mechanism is a hydraulic door closer.

DETAILED DESCRIPTION OF THE PREFERRED EMBODIMENTS

Figure 5:
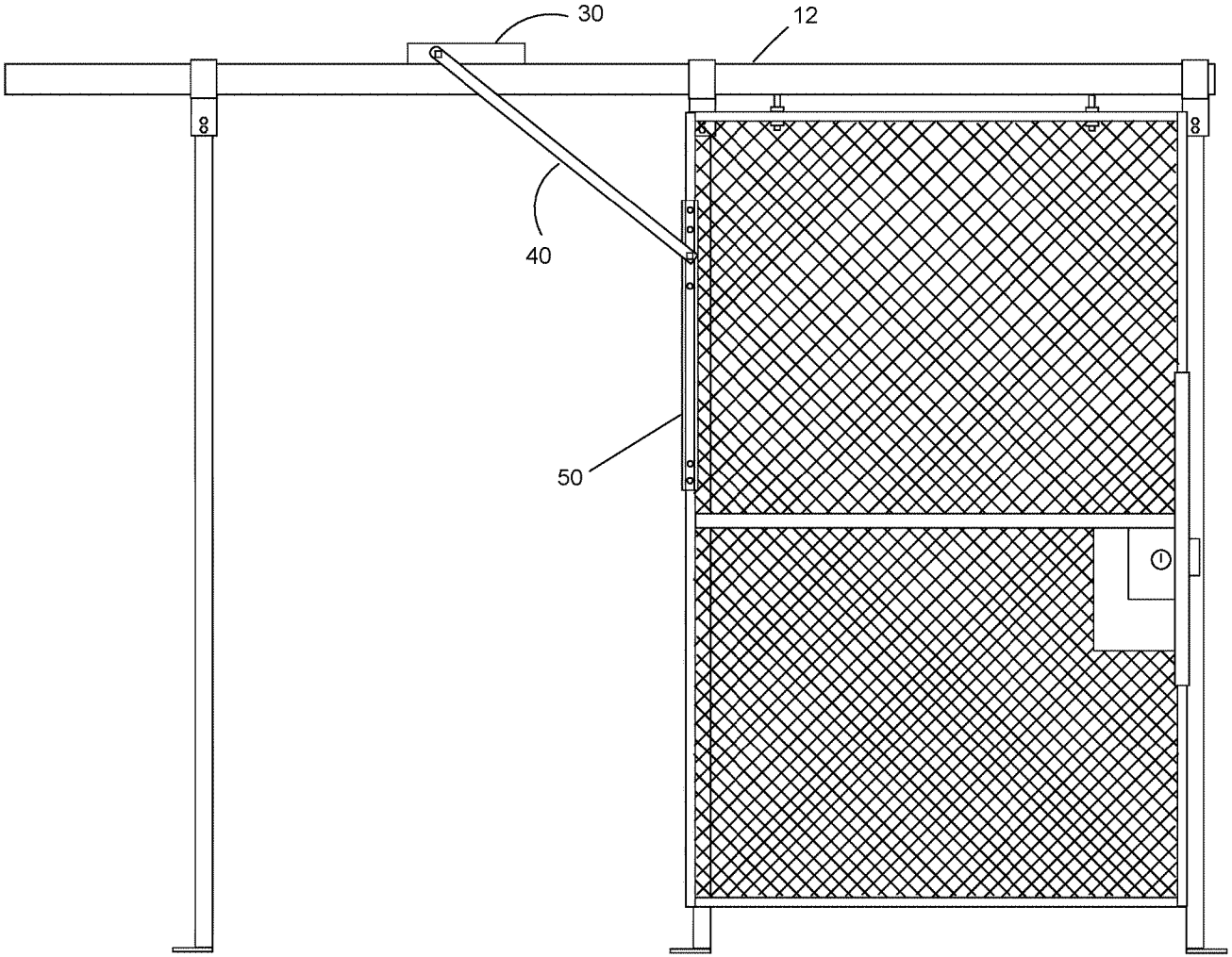
FIG. 5 shows a front view of a preferred embodiment of the present invention.

FIG. 5 shows a first preferred embodiment of the present invention. Wire mesh sections 3 are connected (as shown above) but are not shown in the drawings to allow for a more clear view of the operation of the present invention.

Figure 1:
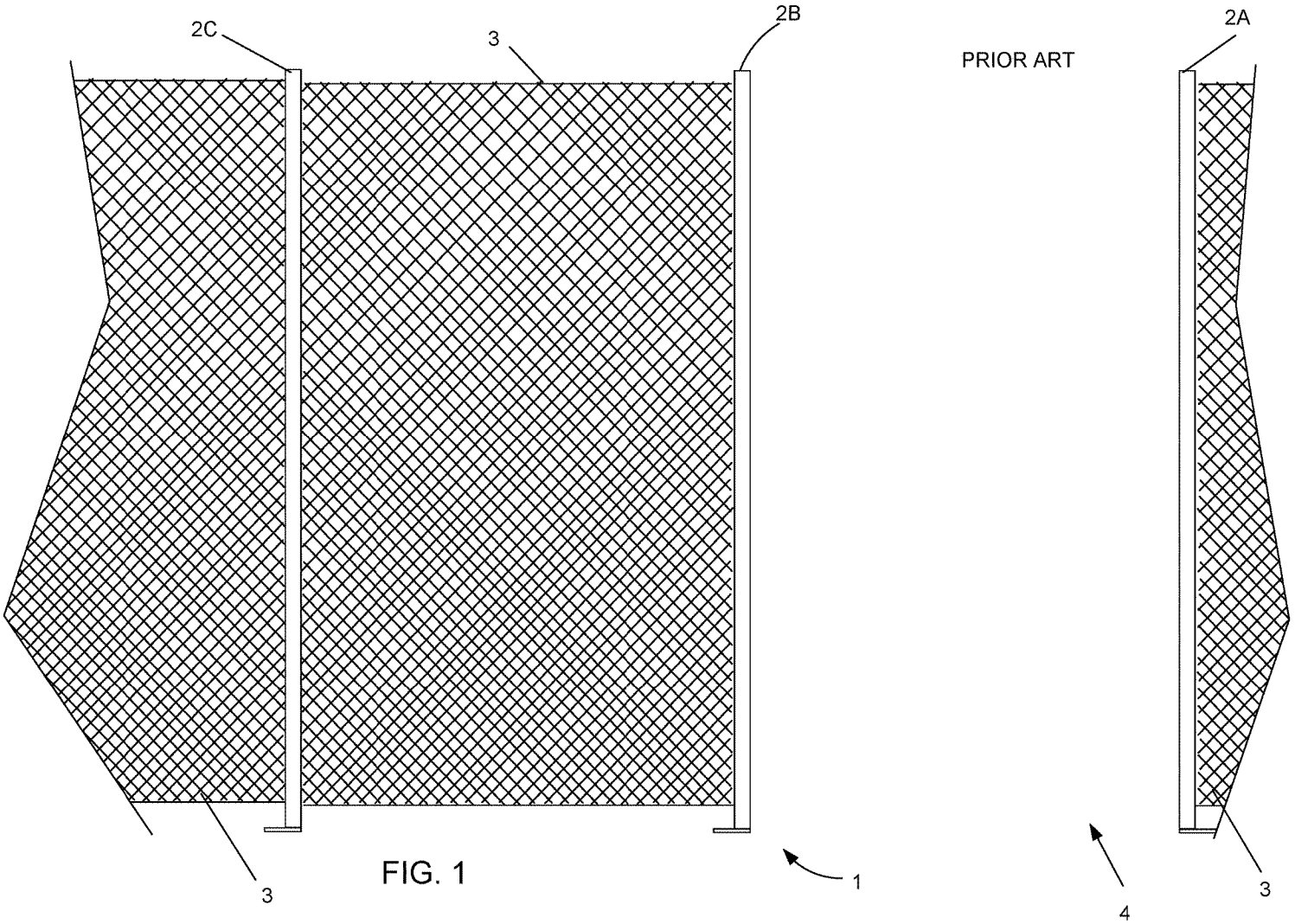
FIG. 1 shows a prior art wire mesh enclosure.
Figure 2:
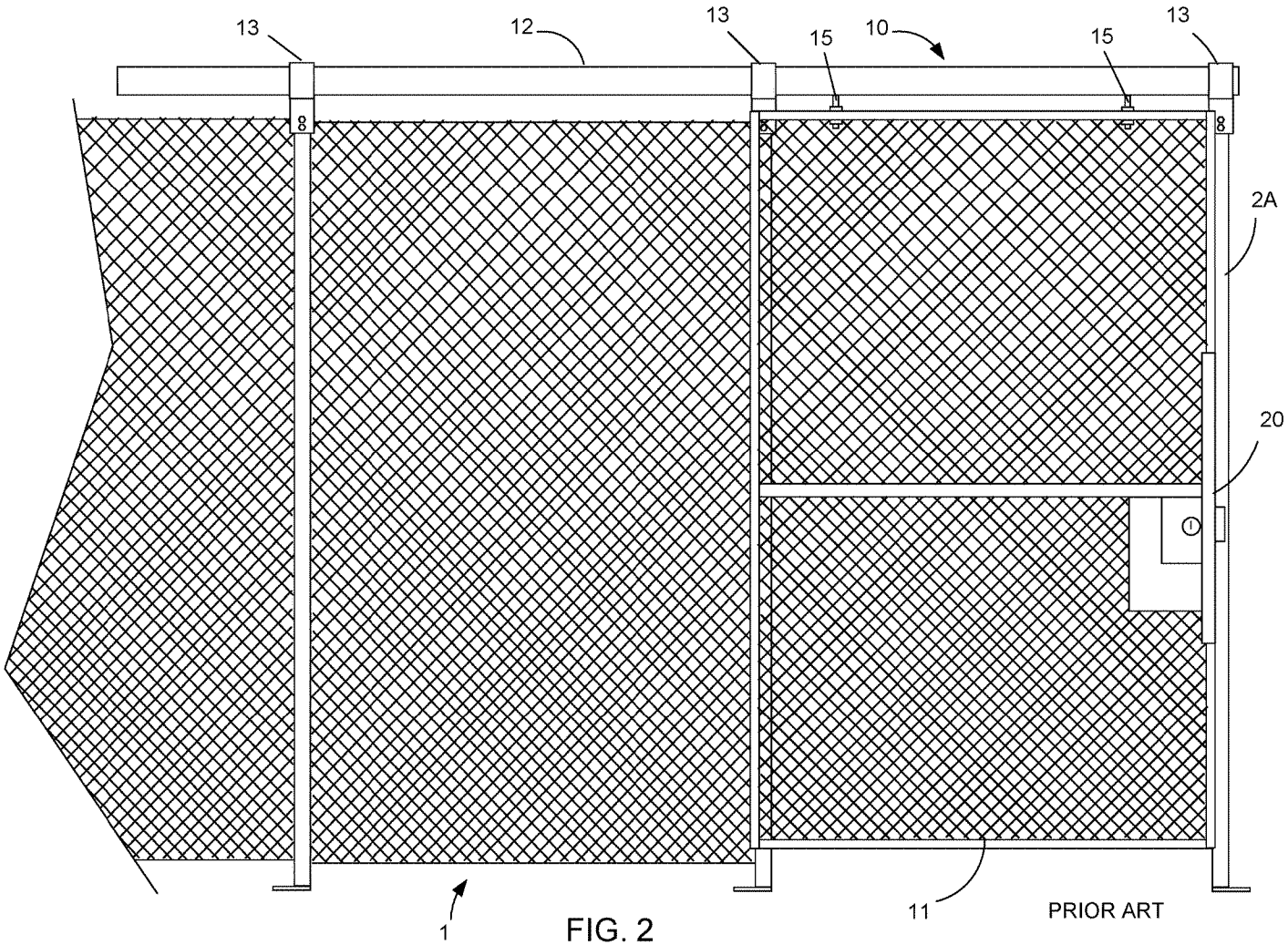
FIGS. 2, 3A, and 4 show a prior art sliding door connected to a wire mesh enclosure.
Figure 3B:
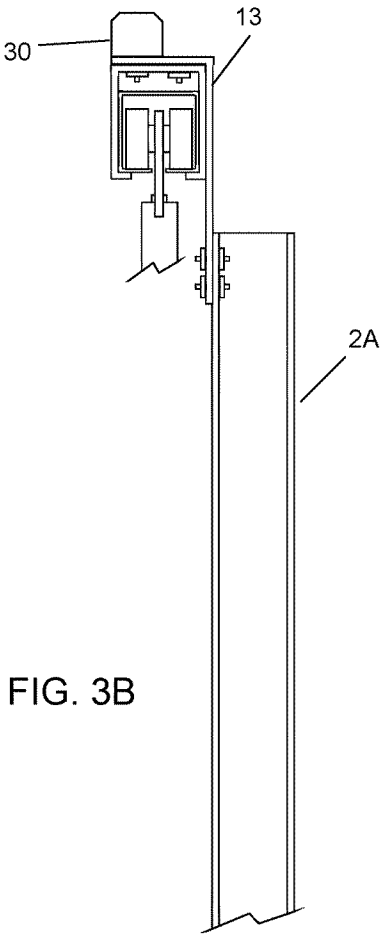
FIG. 3B shows a side view of a preferred embodiment of the present invention.
Figure 3A:
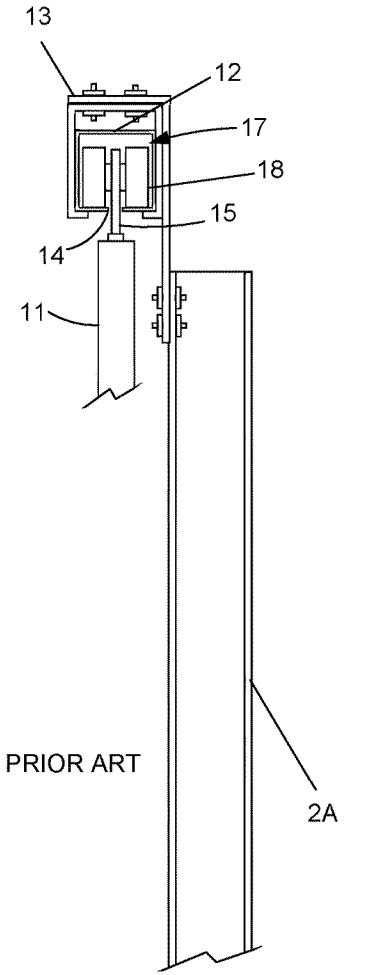
Figure 4:
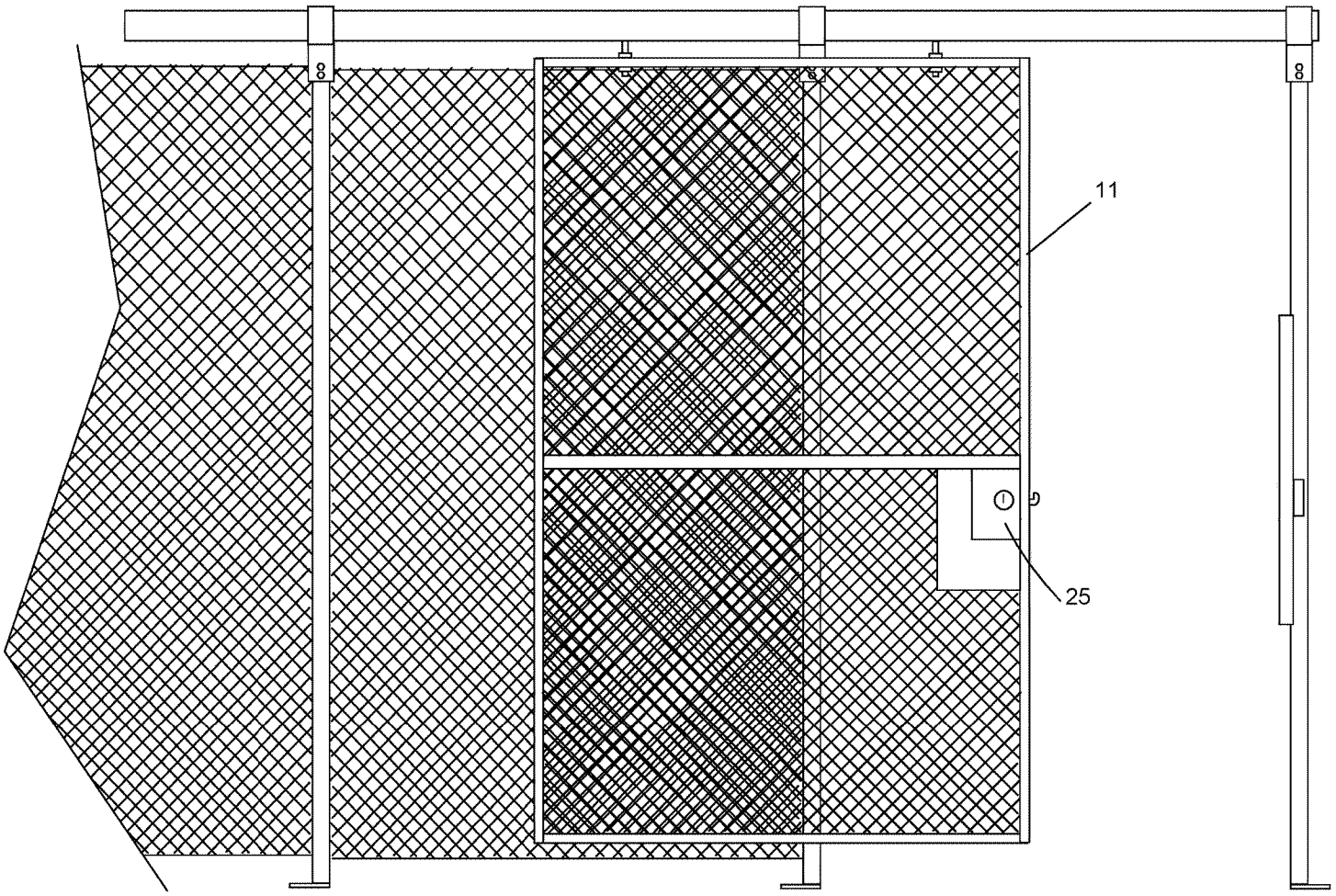
PRIOR ART FIG. 4
Figure 7:
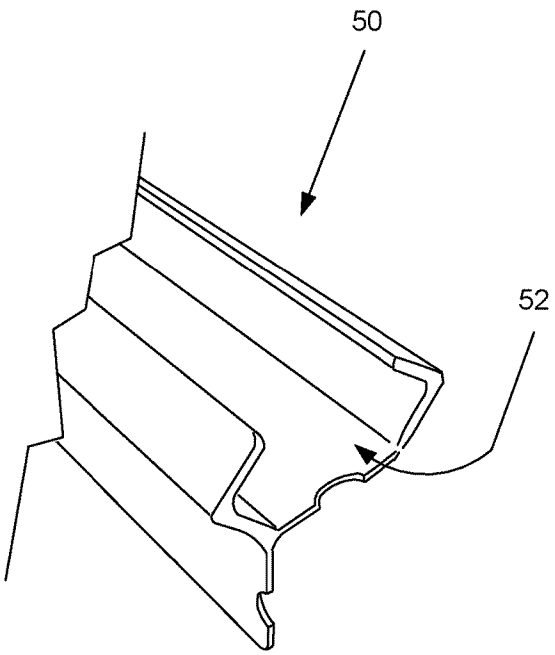
FIG. 7 shows a preferred door roller track.
Figure 6:
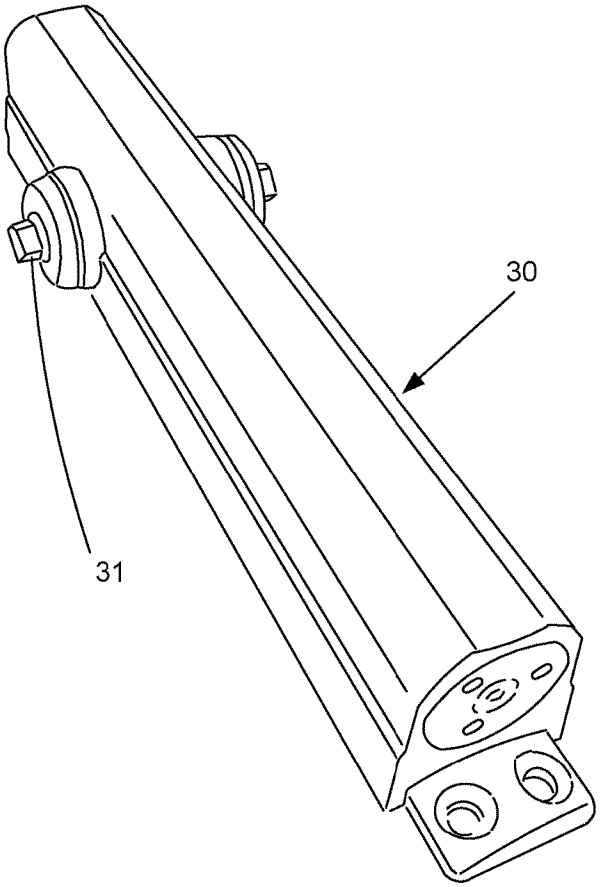
FIG. 6 shows a hydraulic door closer.
Figure 8:
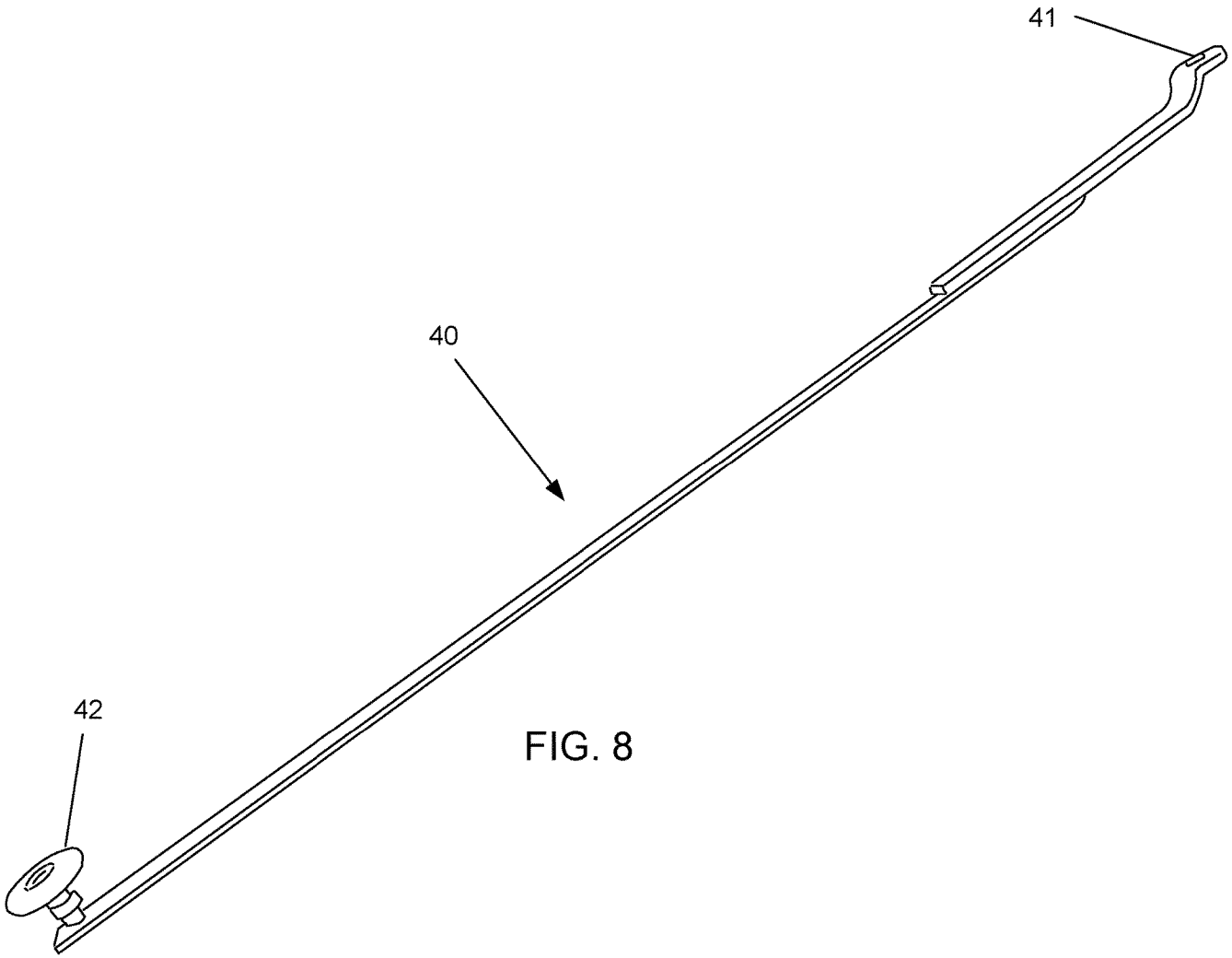
FIG. 8 shows a preferred connection arm.

Hydraulic door closer 30 is rigidly connected to the top of track 12 (see also FIG. 3B). Hydraulic door closer 30 includes a mechanical spring and hydraulic damping system and is biased to close in a counterclockwise direction. A detailed view of hydraulic door closer 30 is shown in FIG. 6. Hydraulic door closer 30 includes rotatable connection axis 31. Connection axis 31 is engaged with a mechanical spring inside hydraulic door closer 30. Connection arm 40 is rigidly connected to connection axis 31, as shown. A detailed view of connection arm 40 is shown in FIG. 8. Connection arm 40 includes connection aperture 41 at one end and roller 42 rotatably connected at the other end. As described above connection aperture 41 rigidly connects to connection axis 31 of hydraulic door closer 30. Roller 42 is inserted inside door roller track 50 (FIG. 5). Door roller track 50 is rigidly connected to door 11 as shown. A detailed view of door roller track 50 is shown in FIG. 7. In a preferred embodiment, holes are drilled into door roller track 50 and it is bolted to door 11 as shown in FIG. 5. Door roller track 50 includes a track section 52 for receiving roller 42 of connection arm 40.

Utilization of the Present Invention

Figure 9:
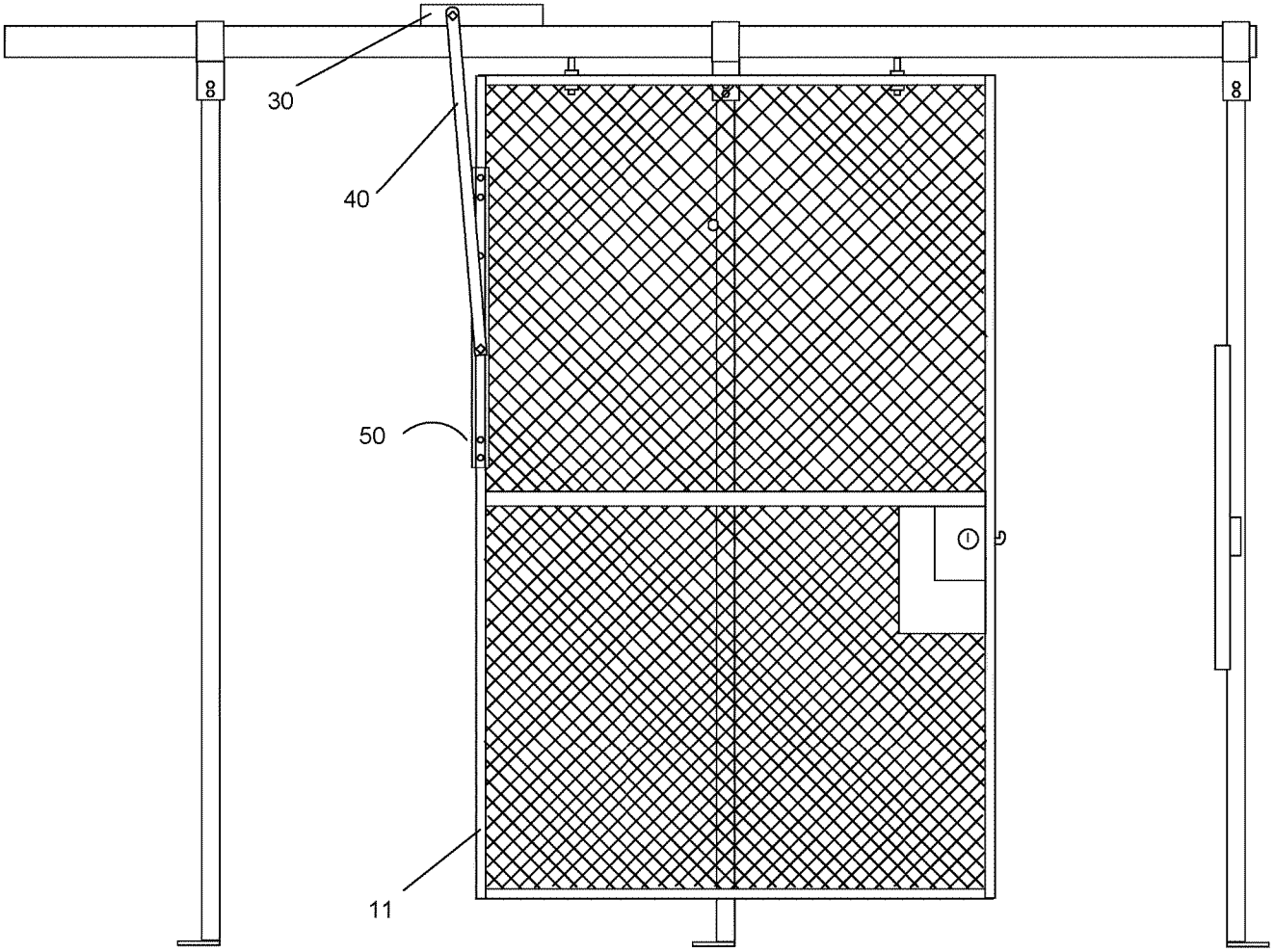
FIGS. 9-12 shows the utilization of a preferred embodiment of the present invention.

In FIG. 9, the user has opened unlocked door 11 and has opened it to the position shown. Connection arm 40 has rotated clockwise. Roller 42 has moved downwards in track 50.

Figure 10:
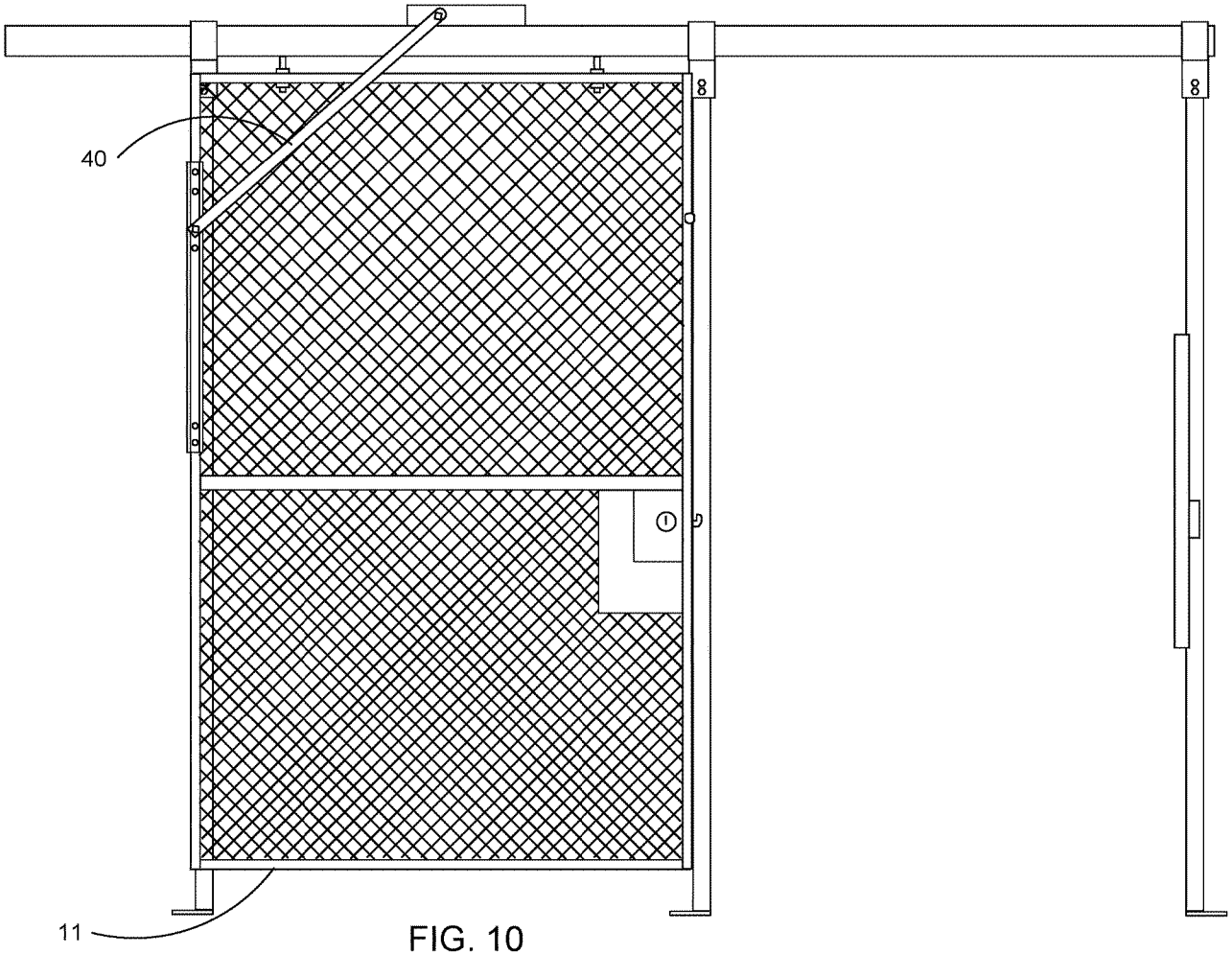

In FIG. 10, the user has slid door 11 further to the left so that opening 4 is completely exposed to allow easy entry and exit into wire mesh enclosure 1. Connection arm 40 has rotated further clockwise. Roller 42 has moved upwards in track 50.

Figure 11:
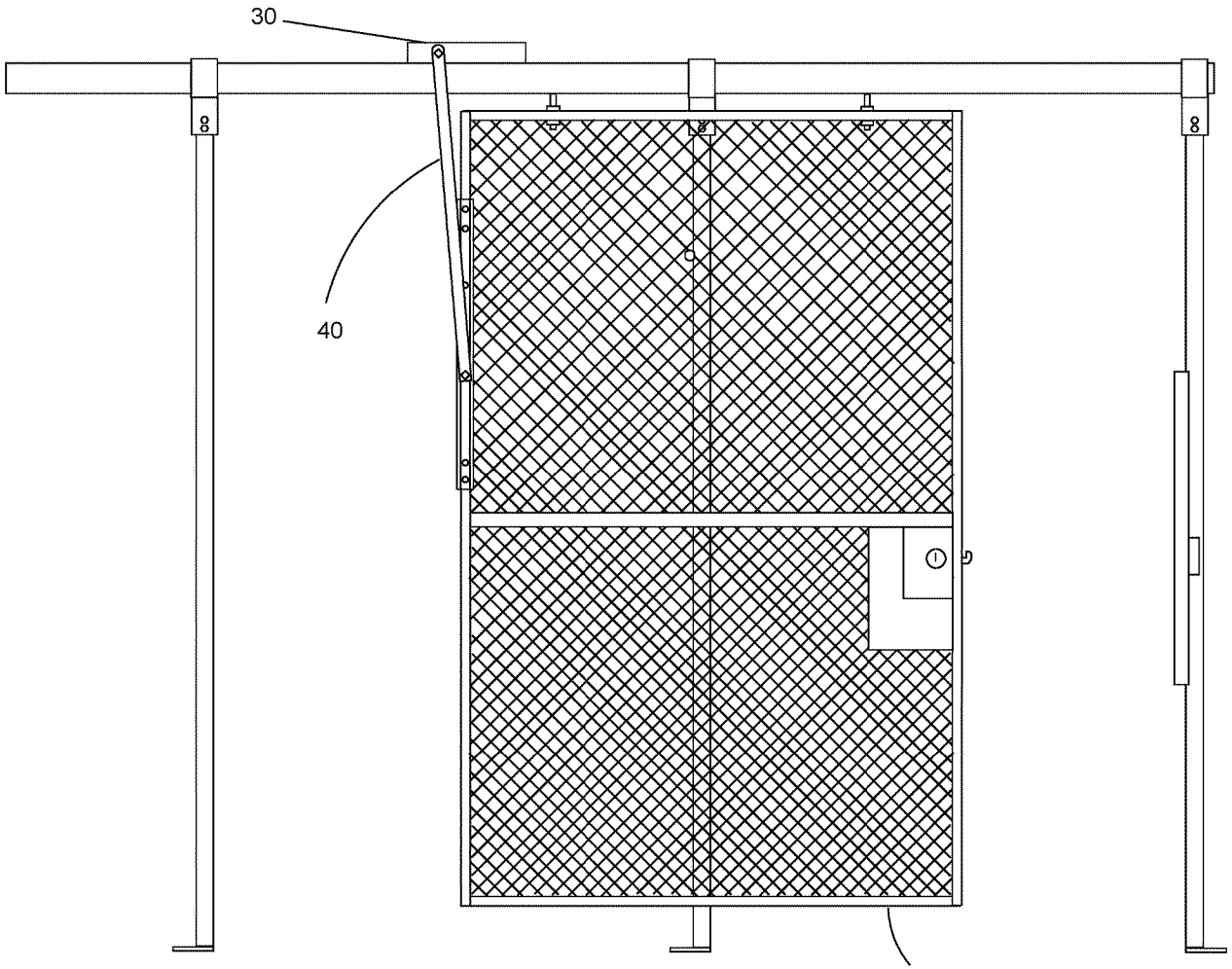

In FIG. 11, the user has released door 11. The spring in hydraulic door closer 30 is biased to rotate connection arm 40 counterclockwise. As a result sliding door 11 is sliding towards the right as shown.

Figure 12:
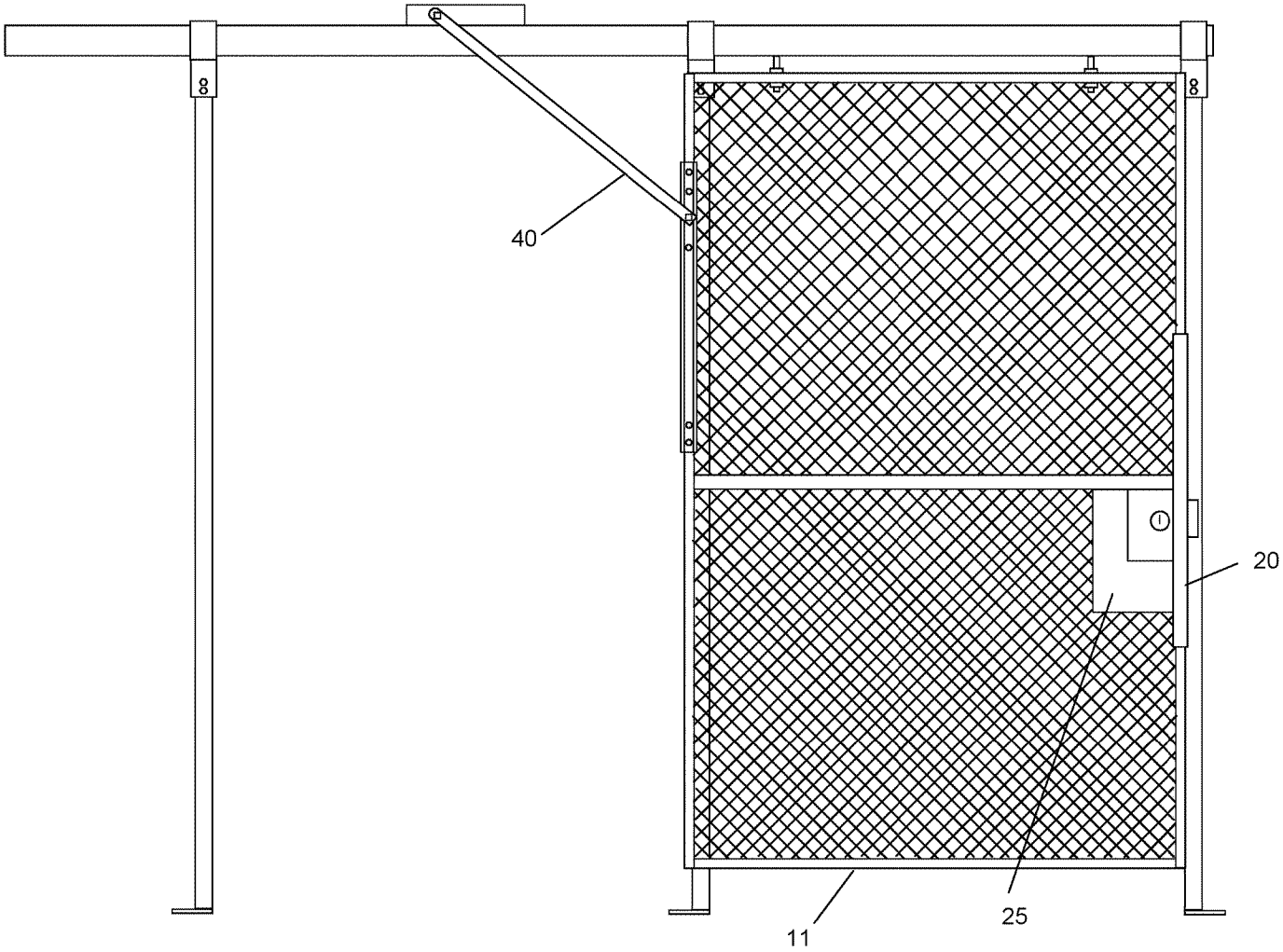

In FIG. 12, door 11 has slid completely to the right and has closed locked shut with lock 25 engaged with strike plate 20.

- - -

While the present invention has been described in terms of preferred embodiments, the reader should consider these described embodiments only as particular embodiments. Many other embodiments are possible. Therefore, the reader should determine the scope of the present invention by the claims and their legal equivalents.

What is claimed is:

1. An automated sliding door closing system, comprising:

A. wire mesh enclosure support brackets,

B. wire mesh connected between said support brackets,

C. a plurality of sliding door track connection brackets connected to said wire mesh enclosure support brackets, D. a sliding door track connected to said plurality of sliding door connection brackets and having a top surface, E. a plurality of sliding door connection bolts slidingly connected to said sliding door track and extending downward from said track, F. a sliding door connected to said plurality of sliding door connection bolts, G. a spring biased closing mechanism mounted on and extending upward from the top surface of said sliding door track, wherein said spring biased closing mechanism is biased to close said sliding door, wherein said spring biased closing mechanism comprises:

a. a mechanical spring with a hydraulic damping system, and b. a connection axis connected to said mechanical spring, H. a door roller track connected to said sliding door, and I. a connection arm comprising a closing mechanism connection end and a door roller track connection end, wherein a roller is rotatably connected to said door roller track connection end, wherein said closing mechanism connection end is connected to said connection axis of said spring biased closing mechanism and wherein said roller is inserted into said door roller track, wherein said connection arm automatically rotates to close said sliding door after said sliding door has been opened.

2. The automated sliding door closing system as in claim 1, wherein said sliding door further comprises a lock for locking said sliding door in a closed postion.

3. The automated sliding door closing system as in claim 1, further comprising a strike plate connected to one of said wire mesh support brackets.

* * * * *